US006547351B1

(12) United States Patent
Wilson

(10) Patent No.: US 6,547,351 B1
(45) Date of Patent: Apr. 15, 2003

(54) DYNAMIC IMPEDANCE MATCHING NETWORKS

(75) Inventor: Eugene Wilson, Culver City, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/559,285

(22) Filed: Apr. 27, 2000

(51) Int. Cl.[7] ..... B41J 2/01
(52) U.S. Cl. ..... 347/9; 347/12
(58) Field of Search ..... 347/9, 10, 19, 347/46, 12, 40

(56) References Cited

U.S. PATENT DOCUMENTS 4,701,732 A * 10/1987 Nestlerode ..... 334/56
5,389,956 A * 2/1995 Hadimioglu et al. ..... 347/12
5,912,679 A * 6/1999 Takayama et al. ..... 347/10
6,225,756 B1 * 5/2001 Gitsevich ..... 315/248

* cited by examiner

*Primary Examiner*—Craig Hallacher
(74) *Attorney, Agent, or Firm*—Kent Chen

(57) ABSTRACT

An improved matching networks for matching the impedance of a source of variable frequency oscillating energy to a variable load is described. The described matching network includes variable capacitances that can be changed to maintain an impedance match between a source and a load despite rapid changes in the frequency output by the source and rapid changes in load impedance.

17 Claims, 5 Drawing Sheets

FIG. 4
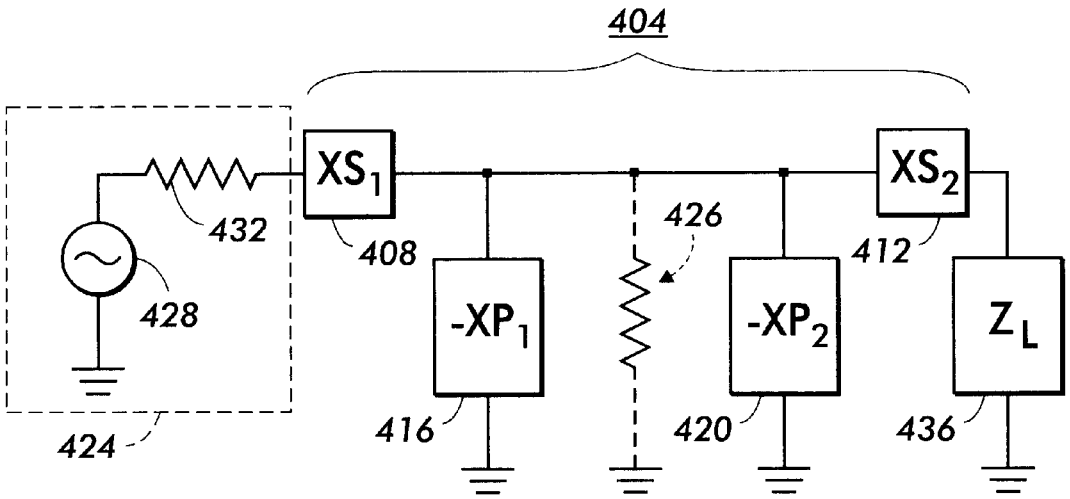
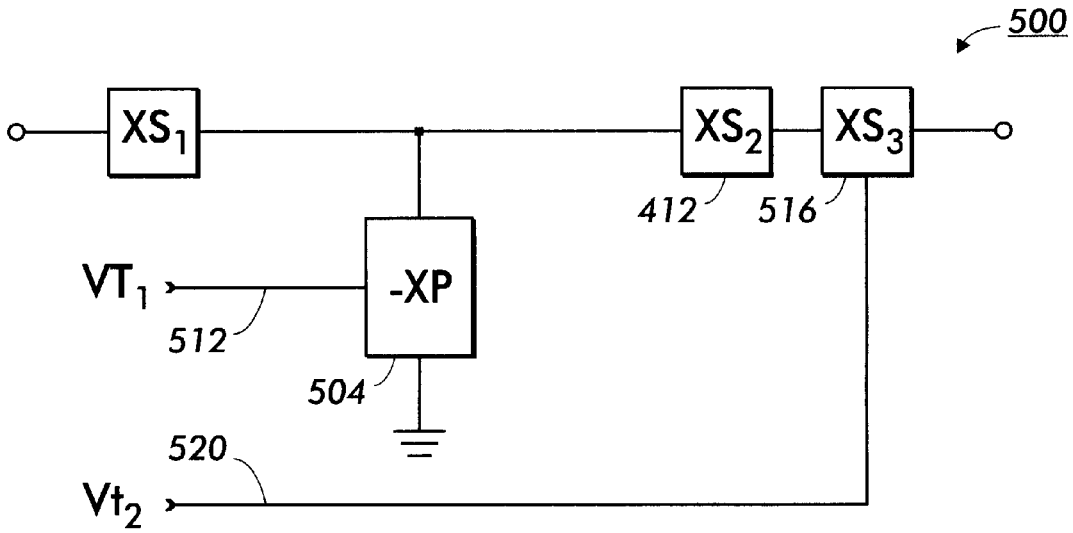
FIG. 5

DYNAMIC IMPEDANCE MATCHING NETWORKS

BACKGROUND

Acoustic Ink Printers (AIP), utilize acoustic waves to drive ink droplets from an AIP Print head. Acoustic waves generate droplets that are smaller and more precisely directed then current ink jet printers. A description of AIP printers is provided in U.S. patent application Ser. No. 09/363,593 entitled Method and Apparatus to Provide Adjustable Excitement of a Transducer in a Printing System in Order to Compensate for Different Transducer Efficiencies, filed Jul. 29, 1999, assigned to Xerox Corporation and hereby incorporated by reference.

In order to provide oscillating energy for an AIP printhead, a RF source is typically coupled to the AIP printhead. Optimal transfer of power from the RF source to the AIP printhead occurs when the output impedance of the RF source matches the input impedance of a load. In an AIP system, the load is an AIP printhead. However, in typical AIP systems, several factors make it difficult to match the source and load impedance.

A first factor that makes it difficult to match impedances is the changing frequency output of the RF source. In AIP systems, the frequency of the RF source output continuously changes over a predetermined frequency range to prevent the formation of standing waves and resonant effects within the AIP printhead. Unfortunately, changing the frequency of the RF source also makes it difficult to create an impedance match between the RF source and the AIP printhead because the impedance of the AIP printhead is a function of frequency. Changing frequencies result in a varying reactive component of impedance that makes it difficult to maintain an impedance match.

A second complication that makes it difficult to create an impedance match arises from the changing number of ejectors being fired. A typical AIP printhead includes a plurality of ejectors distributed across the printhead. The number of ejectors fired changes with the density of ink needed on an image. For example, when printing a dark image, multiple ejectors may be fired simultaneously to darken a region of a drawing. When printing a "light" image, one or even no ejectors may be fired for extended periods of time. Each ejector is associated with an impedance. Thus, changing the number of ejectors fired changes the overall impedance of the printhead.

Due to the previously described difficulties, most current acoustic ink printing systems do not match impedances. Instead, current systems compensate for power losses by using higher powered RF sources that provide larger amounts of power. However, such systems are inefficient and consume significant amounts of power. The wasted power generates heat that must be removed.

Thus an improved method and apparatus to transfer power from a variable frequency source such as a RF source to a variable load such as an AIP printhead is needed.

SUMMARY OF THE INVENTION

An improved matching network for matching the impedance of a source of variable frequency oscillating energy to a variable load is described. The described matching network includes a first reactive element that adjusts a first capacitance according to the frequency of the received oscillating energy. The matching network also includes a second reactive element that adjusts a second capacitance according to the impedance of a load. By adjusting the impedances of the two reactive elements, an approximate impedance match between the variable frequency oscillating energy source and the variable load is achieved. The described matching network is particularly suitable for use in acoustic ink printing systems, although the matching network is also useful in other systems, and the invention should not be limited to acoustic ink printing systems.

BRIEF DESCRIPTION OF THE DRAWINGS

FIG. 4 illustrates a matching network that utilizes back to back "L"s to form an impedance matching network.

FIG. 5 illustrates the impedance matching network of FIG. 4 in which the shunt impedances are summed and both a shunt impedance and a series impedance are made variable.

DETAILED DESCRIPTION OF THE INVENTION

Figure 1:
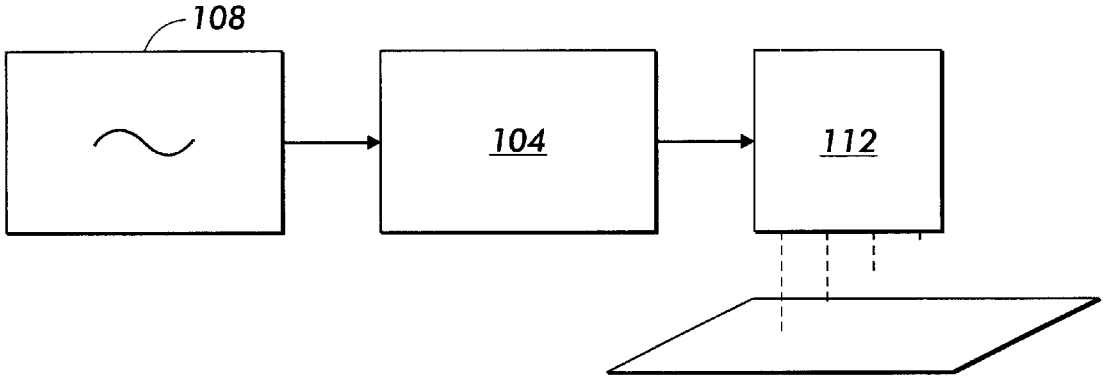
FIG. 1 is a block diagram that shows the use of an impedance matching network between a RF source and a printhead.

FIG. 1 illustrates an impedance matching network 104 that transfers output from a RF source 108 to a load such as a printhead 112. When used for AIP printing applications, the RF source typically outputs a driver signal that ranges in frequency between 135 and 155 Megahertz (MHz), although other frequency ranges are possible.

Figure 2:
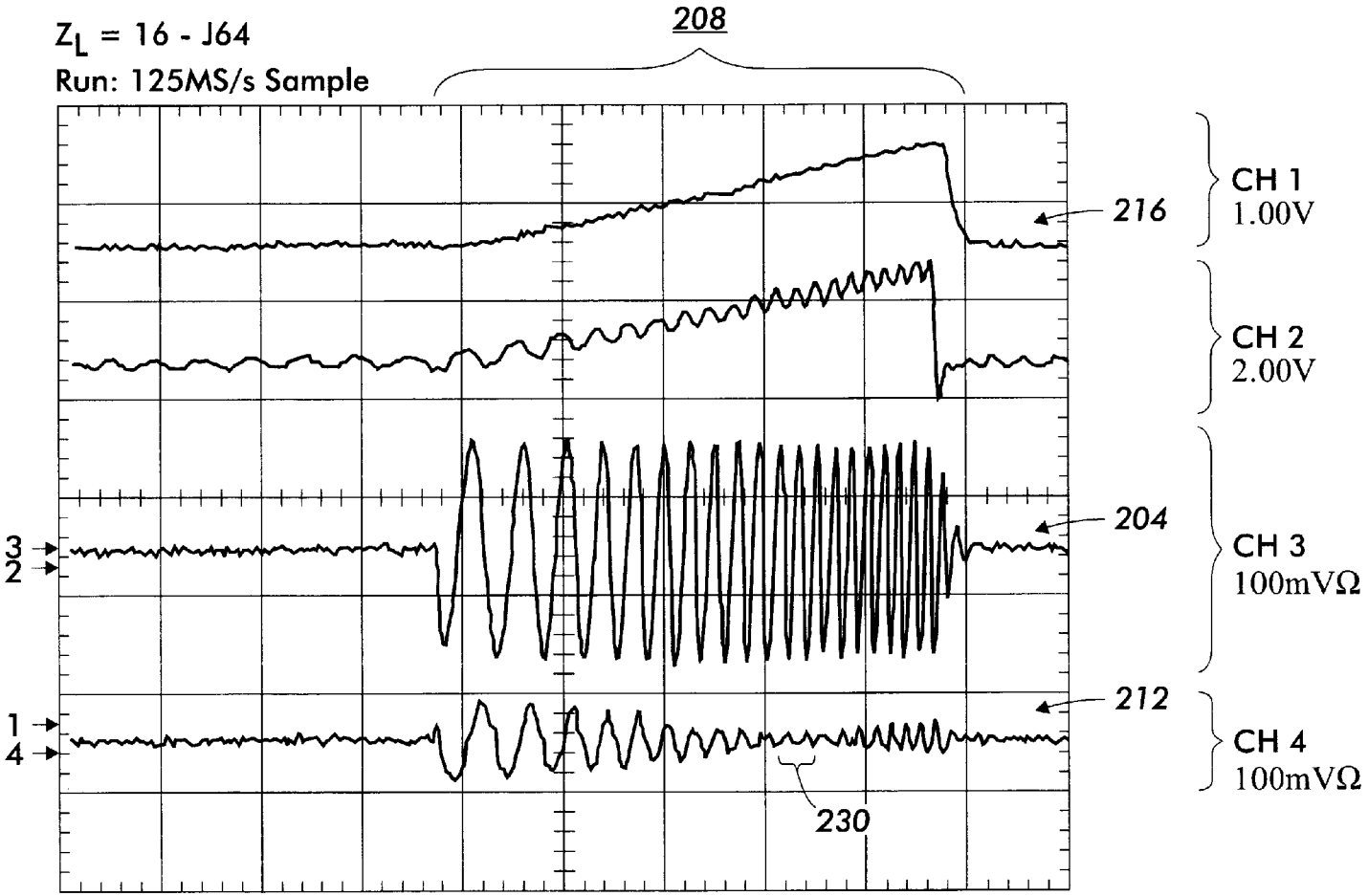
FIG. 2 are example plots illustrating the signals processed and output by a sample impedance matching network.

In FIG. 2, plot line 204 represents one example of a driver signal output by RF source 108 of FIG. 1. The driver signal provides energy to ink ejectors on AIP printhead 112. In the driver signal illustrated by plot line 204, the frequency of the driver signal increases approximately linearly, from 135 MHz to 155 MHz, over each cycle such as period 208.

Figure 3:
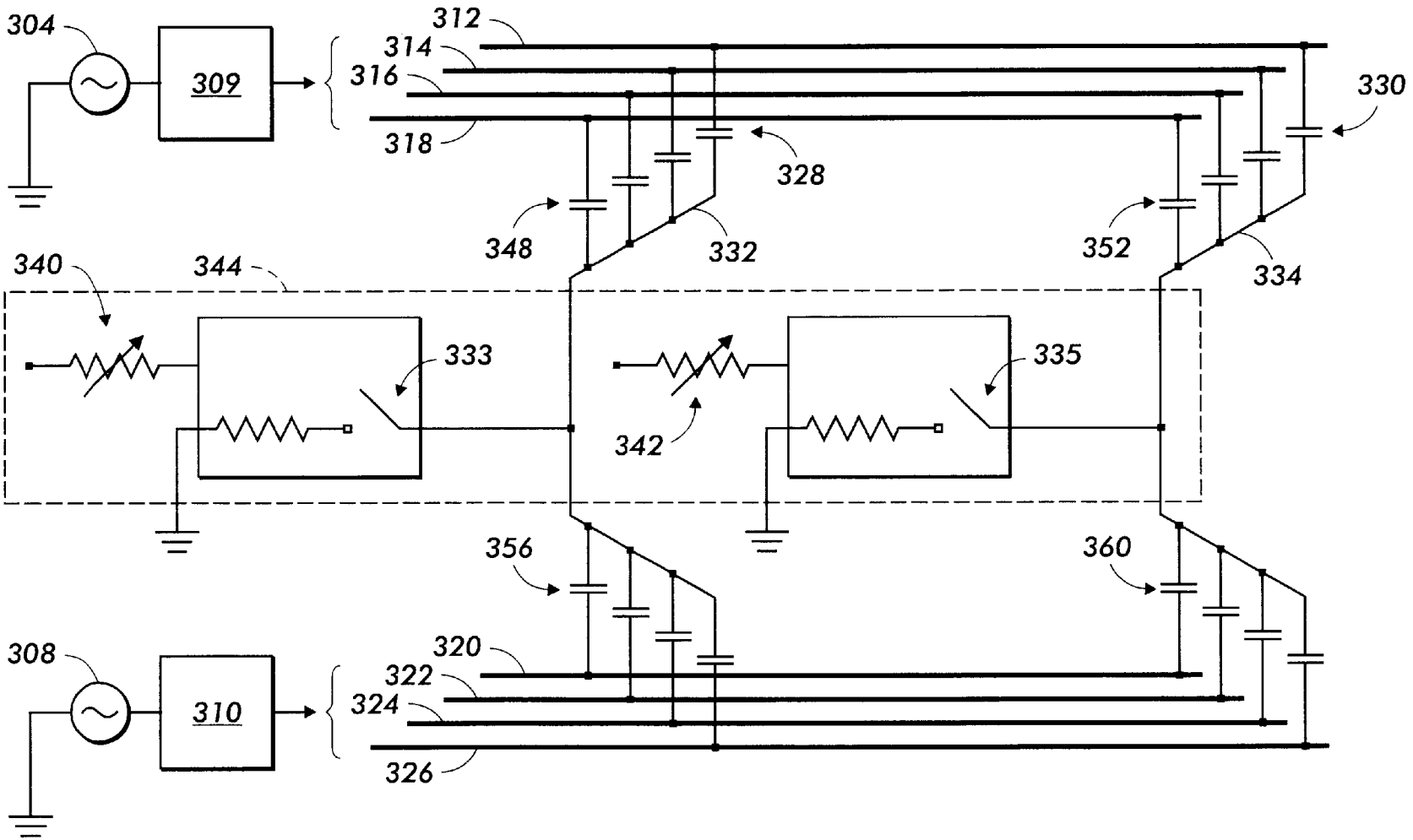
FIG. 3 illustrates a switching circuit in a typical AIP printhead load.

FIG. 3 illustrates one example of a switching architecture in an AIP printhead that serves as part of load 112 of FIG. 1. In FIG. 3, the illustrated switching architecture receives driver signals from a RF energy source and a matching network and redirects the signal to a plurality of transducers. Each transducer provides acoustic energy for a corresponding droplet source. In the illustrated embodiment, two RF sources 304, 308 provide RF energy through respective matching networks 309, 310 and then along row lines 312, 314, 316, 318, 320, 322, 324, 326. Each row line, such as row line 312, is coupled to one or more corresponding transducers, such as transducers 328, 330. The output of transducers 328, 330 are controlled by the signal along row line 312 and the signal transmitted along columns 332, 334. Only when RF source 304 provides a RF signal along row line 312 and an appropriate input is transmitted along column 332 does transducer 328 receive sufficient energy to output a droplet. In one embodiment of the invention, the "signal" along columns 332, 334 is determined by the setting of "three-terminal" switches 333, 335. When switch 333 is closed, column 332 is coupled to ground. When switch 333 is open, column 332 is left electrically floating. In one embodiment of the invention, each of the switches may be implemented as a "three-terminal switch" as described in U.S. Pat. No. 5,757,065 issued to Buhler, et al. and hereby incorporated by reference. By synchronizing the timing of the RF signal along row lines with the timing of the switches, the output of transducers 328, 330 can be independently controlled. In the illustrated embodiment, the timing of the switches is controlled by the timing of the injector current in each switch.

In one embodiment of the invention, resistors 340, 342 are variable resistors, typically metal oxide semiconductors (MOS) transistors. The resistance of resistors 340, 342 controls the amount of current flowing from the transducers and along columns 332, 334. In one embodiment of the invention, switches 333, 335 and variable resistors 340, 342 may be implemented as a network on a chip 344 that forms part of the circuitry of a print head driver. As used herein, a print head driver is any circuit that controls the energy delivered to the transducer.

Typically, a switch supplies one of two discrete impedances (typically a "hi" value and a "low" value) to columns 332, 334. A change in the applied impedance changes the amount of current flowing through each transducer to either cause or prevent ejection of a droplet from a droplet source coupled to the transducer. To compensate for the different positions of the transducer with respect to the RF source, as well as to compensate for differences among transducers resulting from variations during the transducer manufacturing process, the resistance of resistors 340, 342 may be adjusted to one of several values to compensate for the line losses which occur. Resistors 340, 342 are set to cause RF source 304 to deliver approximately equal amounts of power to transducer 328 and transducer 330.

As previously described and illustrated in FIG. 3, the setting of resistors 340, 342, as well as the number of capacitors from capacitors 348, 352, 356, 360 coupled to the RF source changes in response to which ejectors are fired and the number of ejectors fired at any particular point in time. In particular, the firing of additional ejectors at a particular moment in time increases the load capacitance.

Returning to FIG. 1, impedance matching network 104 maintains an approximate impedance match between RF source 108 and load 112 despite changing driver frequencies and load impedances. In one implementation of impedance matching network 104, RF source 108 generates a frequency indicator signal with a voltage proportional to the frequency of the drive signal. RF source 108 transmits the frequency indicator signal to impedance matching network 104. Plot line 216 of FIG. 2 illustrates a typical frequency indicator signal that corresponds to the drive signal of plot line 204. One embodiment of an impedence matching network that uses the frequency indicator signal of plot line 216 will be described in FIG. 6. In some commercially available RF generators, the frequency indicator signal can be obtained from a scaled output of the ramp generator of the RF generator.

Figure 6:
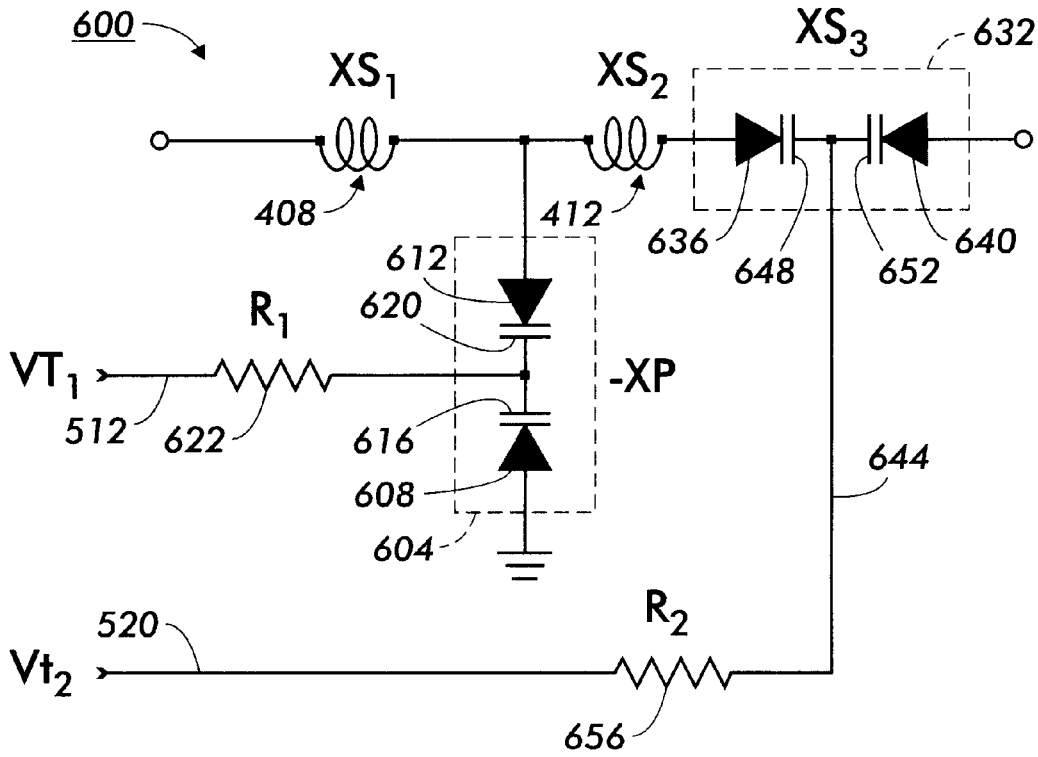
FIG. 6 illustrates one embodiment of the invention in which tuning diodes are used to achieve variable reactive elements that serve respectively as a variable shunt impedance and a variable series impedance for the matching is network.

When used to transfer drive signals for an AIP printer, the impedance matching network uses print information from the print signal to determine load impedance. The print signal is processed to determine how many acoustic ink ejectors are being fired. Changing the number of ink ejectors being fired changes the input impedance of the AIP printhead. FIGS. 4–6 and the accompanying discussion describe an impedance matching network that adjusts capacitances of impedance elements in the impedance matching network to correspond to changing load conditions and thereby minimize the reflected power.

FIG. 4 illustrates a "L" impedance matching network 404 including a first series impedance 408, a second series impedance 412, a first shunt impedance 416 and a second shunt impedance 420. The first series impedance 408 and the first shunt impedance 416 form a first "L" network that matches the output impedance 432 of a source 424 to a virtual resistor 426. The resistance of the virtual resistor is substantially larger than source output impedance 432. Likewise, the second series impedance 412 and the second shunt impedance 420 form a second "L" network that matches the load impedance 436 to virtual resistor 426. The resistance of virtual resistor 426 is also substantially larger than load impedance 436.

In FIG. 4, RF source 424 includes a voltage generator 428 and a source output impedance 432. A typical value for source output impedance 432 is 50 Ohms. Thus virtual resistor 426 will be substantially larger than 50 Ohms. When load impedance 436 is an AIP printhead, the value of load impedance 436 will typically vary from 4-j16 to 16-j64 Ohms for frequencies between 135 MHz and 155 MHz.

The "L" impedance circuit of FIG. 4 can be simplified by combining first shunt impedance 416 and second shunt impedance 420 into a combination shunt impedance 504 of FIG. 5 to form a "T" impedance circuit. The impedance of combined shunt impedance 504 is approximately equal to the sum of shunt impedance 416 and shunt impedance 420. The design of "L" impedance networks and subsequent conversions to the "T" impedance network of FIG. 5 are described on page 73–75 of the book "RF Circuit Design" by Chris Bowick, published in 1982, sixth printing 1988 and hereby incorporated by reference.

Creating a combined shunt impedance 504 does not solve the problem of changes in impedance of fixed reactive elements (inductors and capacitors) in matching network 500. Each fixed reactive element in matching network 500 changes impedance when the frequency of a drive signal from voltage generator 428 changes. To compensate for changes in frequency, the capacitance or inductance of reactive elements in combined shunt impedance 504 are made variable.

In order to control the inductance and capacitance of reactive elements in shunt impedance 504, frequency indicator line 512 carries a frequency control signal to shunt impedance 504. The frequency control signal communicates the frequency of the drive signal output by the RF source. In one embodiment, the voltage of the frequency control signal is proportional to the frequency of the drive signal. The matching network uses the voltage of the frequency control signal to adjust the impedance of variable reactive elements in shunt impedance 504. One method of implementing a variable shunt impedance 504 that can rapidly respond to changes in frequency of a drive signal will be described in FIG. 6 and the corresponding discussion.

Besides changes in the drive signal frequency, the load impedance may also change. As previously described, load impedance changes may be induced by changing the number of ejectors fired in an AIP printing system. In order to compensate for changes in load impedance, a variable series impedance or "resonator" 516 is coupled in series with series impedance 412. The impedance of reactive elements in the resonator are changed to compensate for load impedance changes.

In the illustrated embodiment, resonator 516 receives a load control signal along a load control line 520. AIP printer circuitry (not shown) that drives the AIP printhead may be used to generate the load control signal. When used for AIP, the load control signal voltage is typically a function of the number of acoustic ink ejectors being fired at a particular point in time. For example, the load control signal voltage may be proportional to the number of acoustic ink ejectors being fired. By adjusting the impedance of variable reactive elements in resonator 516 to correspond to load impedance changes, an approximate impedance match can be maintained. One technique for implementing such a resonator will be illustrated in FIG. 6 and described in the accompanying description.

Different techniques, such as variable inductors and capacitors, may be used to implement variable reactance components. However, most variable components typically have a slow response time. AIP systems require a rapid response time because the number of ejectors fired typically changes within 300 nanoseconds, the time between ejector firings. Higher speed AIP printers may require even shorter times between firings. Thus, the impedance matching network needs to respond very quickly to rapid changes in load impedance as is well as frequency changes in RF output. One element that allows rapid changes in capacitance is a tuning diode. Such tuning diodes are commercially available from Motorola Corporation of Schaumburg, Ill. FIG. 6 illustrates a matching network 600 that uses tuning diodes to achieve a variable resonator and a variable shunt impedance. The described circuit is able to respond to changes in ejector firings on the order of 30 nanoseconds.

In FIG. 6, a "transformer" or variable shunt impedance 504 is implemented using a pair of shunt tuning diodes 608, 612. Cathode 616 of shunt tuning diode 608 is coupled to cathode 620 of shunt tuning diode 612. A frequency control signal is applied along frequency indicator line 512 to the cathodes 616, 620 of each tuning diodes 608, 612. The frequency control signal includes a direct current (D.C.) offset voltage that keeps both tuning diodes 608, 612 under constant reverse bias. The D.C. offset is typically about five volts when the tuning diodes are MV4001 tuning diodes from Motorola Corporation. A resistor 622 on frequency indicator line 512 controls current, although under most conditions, the constant reverse bias of tuning diodes 608, 612 maintains a low current. A forward bias of tuning diodes 608, 612 can result in high power dissipation that damages the tuning diodes.

A frequency indicator signal that indicates the frequency of the drive signal is superimposed on the D.C. offset voltage. The frequency control signal is the sum of the frequency indicator signal and the previously described D.C. offset voltage. When the drive signal linearly increases in frequency, the RF source generates a ramp signal voltage that linearly increases with the increasing frequency of the RF source. The ramp signal can be scaled and used as the frequency indicator signal. Plot 216 of FIG. 2 shows such a ramp signal that serves as a frequency indicator signal. As the voltage of the frequency indicator signal increases, the voltage of the frequency control signal that is applied to the tuning diodes also increases. The increase in the frequency control signal voltage increases the reverse bias on tuning diodes 612, 608 of FIG. 6. The increasing reverse bias decreases the capacitance of tuning diodes 608, 612. For example, in the previously described Motorola tuning diodes, as the reverse bias increases linearly from 5 volts to 6 volts, the capacitance decreases linearly from a maximum of approximately 30 picofarads at a 5 volts reverse bias to approximately 17 picofarads at a 6 volt reverse bias. Thus, as the drive signal increases in frequency, the capacitance of transformer 604 decreases to maintain an approximately constant shunt impedance.

FIG. 6 also illustrates a variable resonator 632 to adjust for changes in load impedance. Variable resonator 632 is implemented using two tuning diodes 636, 640. The cathode 648 of tuning diode 636 is coupled to cathode 652 of tuning diode 640. Load control line 644 communicates a load control signal to cathodes 648, 652. The load control signal includes a DC bias that maintains reverse biasing of tuning diodes 636, 640. Current control resistor 656 further prevents excessive current from flowing through load control line 644, although the reverse biasing of tuning diodes 636, 640 will typically prevent excessive current.

As previously described, when used in an AIP system, the load control signal communicates information on the number of ejectors fired at a particular point in time. In one embodiment of the invention, circuitry within the AIP printer converts the number of ejectors to be fired into a voltage. The computed voltage is added to the DC offset to generate the load control signal that is applied to the cathodes of tuning diode 636, 640.

In some AIP print heads, the capacitance increases approximately linearly with an increase in the number of ejectors being fired. To compensate for the increased capacitance, the voltage of the load control signal is decreased. A decrease in the load control voltage decreases the reverse bias and thereby increases the combined capacitance of the tuning diodes 636, 640. When Motorola tuning diodes are used, a 6 volt reverse bias across a tuning diode may result in an approximately 17 pF capacitance. As the reverse bias voltage decreases, the capacitance of the tuning diode increases linearly with the decrease in bias voltage until the capacitance is approximately 30 pF at a reverse bias of 5 volts. The change in capacitance of tuning diodes 636, 640 offsets inductances in first series impedance 408, and second series impedance 412 to maintain an impedance match between source and load. In the illustrated example, the absolute value of the combined impedance that results from the sum of the inductance of second series impedance 412 and the capacitance of is variable resonator 632 is set equal to the absolute value of the impedance resulting from the capacitance of the load.

Changing the number of ejectors fired also changes the load resistance, the "real" part of the impedance. However, it has been found that changes in load resistance can be tolerated while still maintaining a reasonable standing wave ratio (SWR). In AIP systems, power losses resulting from impedance mismatches due to "real" part or resistance mismatches are small compared to the power losses that occur from impedance mismatches due to changes in the imaginary component of the impedance. Thus, in simple matching networks, compensation for the changes in the resistance may be unnecessary.

Plot line 212 of FIG. 2 illustrates the reflected power when the drive signal illustrated in plot line 204 is input into the matching network circuitry illustrated in FIG. 6. The ramp signal plotted in plot line 216 of FIG. 2 was used as the frequency control signal. As can be seen, the matching condition is optimum at point 230, however, at other frequencies, the standing wave ratio (SWR) remains reasonable.

While the invention has been described in terms of a number of specific embodiments, it will be evident to those skilled in the art that many alternatives, modifications, and variations are within the scope of the teachings contained therein. For example, the preceding specification has described using the matching network in an acoustic ink jet print system. However, other applications of the invention are also possible. Accordingly, the present invention should not be limited by the embodiments used to exemplify it, but rather should be considered to be within the spirit and scope of the following claims, and equivalents thereto, including all such alternative, modifications and variations.

What is claimed is:

1. A printer system including a dynamic impedance matching network for matching the impedance of a source of variable frequency oscillating energy to a printhead impedance of a printhead, the dynamic impedance matching network comprising:

a first reactive element to couple to a source of oscillating energy, the first reactive element including a first capacitance that changes as a function of the frequency of the received oscillating energy; and a second reactive element coupled to the first reactive element, the second reactive element having a second capacitance that changes as a function of changes in the printhead impedance due to different firings of different ejectors in the printhead, such that an approximate impedance match is maintained between the source and the printhead.

2. The printer system including the dynamic impedance matching network of claim 1 wherein the reactive element includes at least one tuning diode.

3. The printer system including the dynamic impedance matching network of claim 2 wherein the reactive element includes a first tuning diode and a second tuning diode, a cathode of the first tuning diode coupled to a cathode of the second tuning diode.

4. The printer system including the dynamic impedance matching network of claim 3 wherein a voltage proportional to a frequency from the source of variable frequency oscillating energy is applied to the cathodes of the first tuning diode and the second tuning diode.

5. The printer system including the dynamic impedance matching network of claim 1 wherein the second reactive element includes at least one tuning diode.

6. The printer system including the dynamic impedance matching network of claim 1 wherein the second reactive element includes a first tuning diode and a second tuning diode, a cathode of the first tuning diode coupled to a cathode of the second tuning diode.

7. The printer system including the dynamic impedance matching network of claim 1 further comprising:

a series inductance coupled in series with the second reactive element, a combined impedance of the series inductance and the second reactive element set to resonate with a load impedance and create an impedance match.

8. A printer comprising:

a source of RF energy;

a printhead that includes a plurality of ink ejectors, the printhead having an impedance that corresponds to the number of ejectors ejecting ink; and a matching network that couples the RF energy from the source to the printhead, the matching network having reactive elements that vary with the frequency of the RF energy and the number of ejectors ejecting ink such that an approximate impedance match is maintained despite changes in frequency of the RF energy and changes in the number of ejectors ejecting ink.

9. The printer of claim 8 wherein the frequency output by the RF source varies between 100 megahertz and 200 megahertz.

10. The printer of claim 8 wherein each ejector uses acoustic waves to eject ink.

11. The printer of claim 8 wherein the matching network comprises:

a transformer including a first reactive element to couple to the source of RF energy, the transformer to compensate for frequency changes in a signal output from the source; and a resonator including a second reactive element coupled to the source of RF energy, the resonator to compensate for changes in load impedance due to changes in the number of ejectors being fired.

12. The printer of claim 8 wherein the matching network receives a signal from the source of RF energy, the voltage of the signal proportional to a frequency of a signal output from the source of RF energy.

13. The printer of claim 8 wherein the first reactive element includes at least one tuning diode.

14. A method of maintaining an impedance match between a RF source and load, the method comprising the operations of:

determining the frequency output from the RF source;

adjusting a first reactive element in an impedance matching network according to the frequency from the RF source;

determining the number of ink ejectors to be fired at a first point in time; and adjusting a second reactive element in the impedance matching network according to the number of ink ejectors to be fired to maintain an impedance match between the RF source and the load.

15. The method of claim 14 wherein the adjusting of the first reactive element includes the operation of applying a voltage set by the output frequency for the RF source to a cathode of a tuning diode.

16. The method of claim 14 further comprising the operations of:

determining at a second point in time a second number of in ejectors to be fired; and adjusting the second reactive element in the impedance matching network according to the number of ink ejectors to be fired at the second point in time to maintain an impedance match between the RF source and the load.

17. The method of claim 16 wherein the first point in time and the second point in time are less than 400 nanoseconds apart.

* * * * *